US005715928A

United States Patent [19]

Bradley

[11] Patent Number: 5,715,928

[45] Date of Patent: Feb. 10, 1998

[54] COIN CHUTE FOR A SLOT TYPE MACHINE AND METHOD THEREFOR

[76] Inventor: Arthur E. Bradley, 2050 Magic Way, #49, Henderson, Nev. 89015

[21] Appl. No.: 805,723

[22] Filed: Feb. 25, 1997

[51] Int. Cl.[6] ..... G07F 1/04; G07F 17/34

[52] U.S. Cl. ..... 194/344; 193/DIG. 1

[58] Field of Search ..... 194/344, 346; 221/194, 195, 196; 193/DIG. 1; 232/55, 64; 206/0.8, 0.81

[56] References Cited

U.S. PATENT DOCUMENTS 1,395,941 11/1921 Beattie ..... 194/344 X 1,924,102 8/1933 Benjamin ..... 194/346 X 4,342,384 8/1982 Fukase et al. ..... 221/9 X

*Primary Examiner*—F. J. Bartuska

*Attorney, Agent, or Firm*—Harry M. Weiss; Jeffrey D. Moy; Harry M. Weiss & Associates, P.C.

[57] ABSTRACT

A chute provides a passageway for coins discharged by a slot machine. The passageway extends from a coin discharge opening of the slot machine, over a coin holding tray of the slot machine to the mouth of a cup or a container or any other desired coin collecting unit.

8 Claims, 1 Drawing Sheet

COIN CHUTE FOR A SLOT TYPE MACHINE AND METHOD THEREFOR

FIELD OF THE INVENTION

This invention relates generally to gaming accessories and methods and, more specifically, to an improved device and method for providing a controlled payout to a person who plays a slot type machine.

DESCRIPTION OF THE PRIOR ART

In the State of Nevada, about 4.666 billion dollars, or approximately 63% of all gaming revenues, is provided by slot type machines. The slot machine revenue is derived from about 95.032 billion dollars that is deposited into the slot type machines by players. Accordingly, slot machine play is an important source of revenue for a casino or other type of establishment having slot type machines for gaming purposes. Because of the importance of the slot machine revenue, the casino or establishment containing the slot machines usually tries to eliminate negative aspects of slot type machine play. The term slot machine or slot type machine as used in this application is intended to encompass all forms of gaming machines that utilize coins and/or payout in coins such as the famous "one armed bandits", video machines such as video poker machines, keno machines, etc., etc.

When a gaming player makes or scores a win while playing a slot machine and/or desires to activate the machine's cash button to retrieve winnings stored in the machine, a plurality of coins are usually disgorged by the slot machine into a coin holding tray. The player manually collects the coins from the tray and deposits them into, for example, the player's pocket, purse or pocketbook, fanny pack, or plastic cup that often carries on its outer surface a logo of the casino or establishment where the slot machines are located.

Usually, the coins in the tray have been previously handled by a multiplicity of people and often a player's hand or hands will become discolored due to handling metal coins that have a residue or metal compound material on the surfaces thereof that create this undesired hand or hands discoloration. Also, people will often drop debris into the tray or even flick ashes into the tray. Although some manual contact with the inside of the tray and/or the coins in the tray may appear to be unavoidable, the player usually desires to limit this manual contact as much as is practical.

Accordingly, there is a need for a device and method that limits the player's manual contact with the inside of the tray and/or with the coins that are disgorged by the slot machine.

SUMMARY OF THE INVENTION

An object of the present invention is to provide an improved device and method for handling coins that are disgorged by a slot machine.

Another object of the invention is to provide an improved device and method for significantly limiting or substantially eliminating manual contact with both the coins that are disgorged by a slot machine and the inside portion of the coin holding tray thereof.

BRIEF DESCRIPTION OF THE PREFERRED EMBODIMENT

According to the present invention, a chute made from a low friction material has one end that is adapted for insertion into a position to redirect all the coins discharged towards the tray of the slot machine.

The invention provides a chute and method that forms a low friction redirected passageway for coins that are disgorged from a slot machine towards the tray thereof. The passageway extends above a bottom coin collecting area of the tray of the slot machine to enable the coins to be passed or redirected to the mouth of a container or other coin collecting object.

Other objects, features, and advantages of the invention should be apparent from the following description of the preferred embodiment as illustrated in the accompanying drawing.

DESCRIPTION OF THE PREFERRED EMBODIMENT

Figure 2:
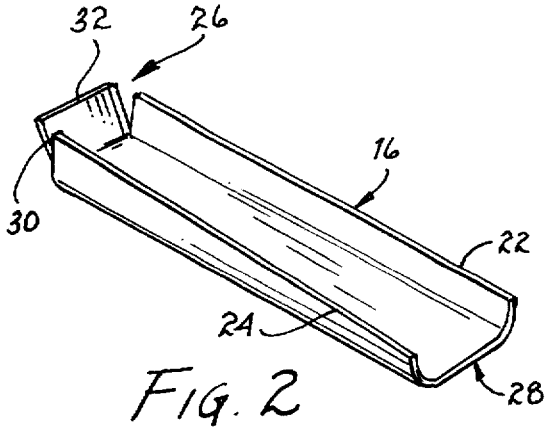
FIG. 2 is an enlarged perspective view of the chute depicted in the embodiment of FIG. 1.
Figure 1:
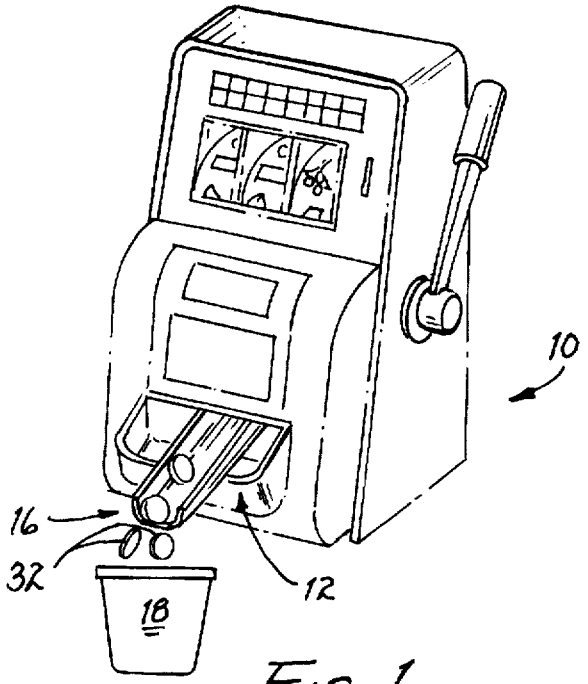
FIG. 1 is a perspective view of the preferred embodiment of the present invention depicting a slot machine and a coin chute to redirect coins discharged by a slot machine into, for example, a container to avoid having the coins land in the coin holding tray thereof.
Figure 3:
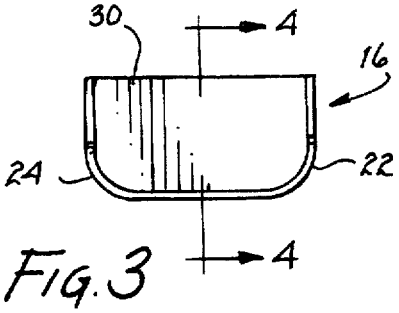
FIG. 3 is a front end view of the chute of FIG. 2.
Figure 4:
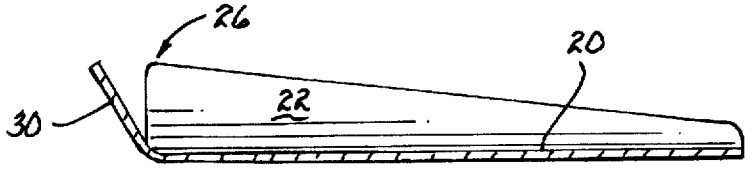
FIG. 4 is a sectional view of FIG. 3 taken along the line 4—4 thereof.

As shown in FIGS. 1–4, a slot machine 10 of a well known type includes a coin holding tray 12 where coins are disgorged therefrom from an opening above the tray 12 (not shown) but generally designated by reference numeral 14 in accordance with the prior art. According to the present invention, a chute 16 having a low friction surface is inserted into the slot machine 10 below the opening 14 to provide a low friction passageway from the opening 14, located over the tray 12 into the mouth of a cup or container 18. If desired, the chute 16 can be similarly used to direct coins from the slot machine 10 into a person's fanny pack, purse, etc.

The chute 16 preferably has a flat bottom 20 that is preferably integrally connected to a tapered side 22 and a tapered side 24 that are similar to each other. The sides 22, 24 are widest at a coin entry end 26 of the chute 16 and narrowest at a coin discharge end 28 of the chute 16. In this embodiment, the chute 16 is preferably made from a plastic with a low coefficient of friction.

Near the end 26, the bottom 20 is preferably integrally connected to a backwardly slanted coin deflection plate 30 that extends away from the end 26 at an angle that can be varied as desired. Preferably, end 32 of the plate 30 is at a height that is substantially equal to the height of the highest width of the sides 22, 24 at the end 26 in order to ensure capture and deflection of all the coins from the slot machine 10.

When the plate 30 and the end 26 of the chute 16 are inserted directly below the opening 14 and a player of the slot machine 10 makes a win, a plurality of coins 32 (see FIG. 1) are disgorged from the slot machine 10 and travel via the chute 16 into the cup 18. Within the slot machine 10, some of the discharged coins 32 fall directly upon the top surface of the bottom 20 of the chute 16 whereas most of the coins 32 strike the deflection plate 30 and are deflected therefrom to the bottom 20 of the chute 16. Because of the low coefficient of friction, all of the coins 32 rapidly travel to the mouth of the cup 18.

Figure 5:
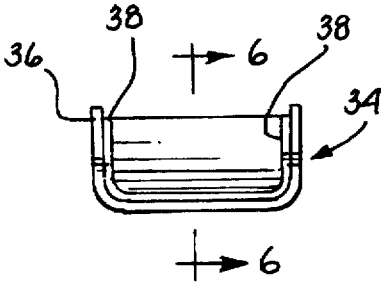
FIG. 5 is an alternative chute that may be used with the slot machine depicted in the embodiment of FIG. 1.
Figure 6:
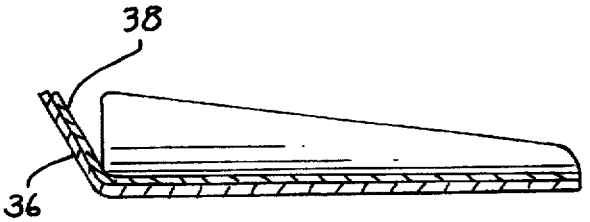
FIG. 6 is a sectional view of FIG. 5 taken along the line 6—6 thereof.

As shown in FIGS. 5 and 6, another embodiment of a chute 34, is depicted with a shape similar to the chute 16. The chute 34 is preferably made from any type of material, is depicted, however, interior surfaces 36 of the chute 34 is a layer or coating 38 having a low coefficient of friction, thereby causing the chute 34 to function substantially the same as the chute 16. In the two chute embodiments, preferably the length of the chute 16 or 34 is about 5 inches and the height of the wall portions thereof is from about two to about three inches.

Accordingly, the chute 16 or 34 is used to substantially capture and redirect all the coins discharged from the slot machine 10 to avoid having the player pick up any coins in the coin holding tray 12.

While the invention has been particularly shown and described with reference to a preferred embodiment thereof, it should be understood by those skilled in the art that changes in form and detail may be made therein without departing from the spirit and scope of the invention.

I claim:

1. In the method of handling coins that are discharged by a slot machine, the steps of:

providing a chute with interior surfaces thereof having a low coefficient of friction; and inserting said chute into the slot machine below a coin discharge opening therein to capture and redirect all coins discharged by the slot machine; said step of providing includes a chute that forms a passageway that extends over and away from a coin holding tray of the slot machine.

2. The method of claim 1 including the additional step of deflecting all the coins out a bottom portion of said chute.

3. A chute for handling coins discharged by a slot machine, comprising in combination:

a slot machine; a coin chute for handling coins discharged by said slot machine, said coin chute comprising:

a flat bottom;

a pair of tapered sides that are connected to said bottom, said sides being widest at a coin entry end of the chute and narrowest at a coin discharge end of the chute; said chute having a passageway that extends over and away from a coin holding tray of the slot machine.

4. The chute of claim 3, additionally comprising a slanted deflection plate connected to said bottom at said coin entry end, said deflection plate and said bottom having a selected angle therebetween.

5. The chute of claim 4 wherein said chute is approximately 5 inches long.

6. The chute of claim 4 wherein a height of said deflection plate is approximately equal to a height of each of said sides at said coin entry end.

7. The chute of claim 4 wherein an upper surface of said bottom is made from a plastic having a low coefficient of friction.

8. The chute of claim 4 wherein said bottom, said sides and said deflection plate are made from one material and additionally comprising a layer carried on interior surfaces of said chute having a low coefficient of friction.

* * * * *